United States Patent [19]

Katsui

[11] Patent Number: 5,020,453

[45] Date of Patent: Jun. 4, 1991

[54] VERTICAL INCINERATOR

[75] Inventor: Seizo Katsui, Osaka, Japan

[73] Assignee: Kabushiki Kaisha Plantec, Osaka, Japan

[21] Appl. No.: 478,396

[22] Filed: Feb. 12, 1990

[51] Int. Cl.[5] ..... F23G 5/04

[52] U.S. Cl. ..... 110/255; 110/225; 110/256; 110/257

[58] Field of Search ..... 110/256, 225, 235, 255, 110/25, 248

[56] References Cited

U.S. PATENT DOCUMENTS 3,570,422 3/1971 Winter ..... 110/225

4,452,154 6/1984 Kono et al. ..... 110/256 X 4,619,210 10/1986 Kennedy ..... 110/256 X 4,732,092 3/1988 Gould ..... 110/256 X

*Primary Examiner*—Edward G. Favors

*Attorney, Agent, or Firm*—Armstrong, Nakaido, Marmelstein, Kubovcik & Murray

[57] ABSTRACT

A vertical incinerator for burning general refuses and industrial wastes which comprises a plurality of sets of grates disposed at different levels within a furnace to divide the furnace into a plurality of combustion chambers in such a manner that the refuse charged into a top portion of the furnace is burnt as it is successively allowed to move downward to become ashes which are withdrawal from the bottom of the furnace.

8 Claims, 2 Drawing Sheets

VERTICAL INCINERATOR

BACKGROUND OF THE INVENTION

1. Field of the Invention

This invention relates to a vertical incinerator for burning general refuses and industrial wastes.

2. Description of the Prior Art

The most usual incinerator known to this day is a stoker type. The stoker type is equipped with a traveling grate adapted to travel in a generally horizontal direction and carry the refuse to be burned thereon. With such a stocker, the refuse is combusted as the grate travels.

However, since the grate of such a stoker travels in a generally horizontal direction, the area of the grate must be very large and, hence, the equipment requires a large installation area. Moreover, this stoker cannot effectively utilize the thermal energy of the hot products of combustion.

To overcome this disadvantage, a vertical incinerator was developed.

The vertical incinerator is mainly a fluidized-bed furnace which is briefly described below referring to FIG. 2.

This refuse pooled in a refuse pit (not shown) is fed to a hopper A by means of a crane (not shown), pulverized by a crusher or a bag breaker B (a machine capable of breaking refuse bags and loosening the blocks of garbage, rubbish and the like), and fed to an incinerating furnace D by means of a feeder C.

The bottom of the incinerating furnace D is provided with an air-jet plate E which carries a pile of high-temperature sand F thereon. As hot air jets for combustion G are blasted against the sand F at high pressure from below the air-jet plate E, the sand F is blown up to form a fluidized bed within the incinerating furnace D. As a commuinuted refuse is fed to this fluidized bed in the furnace D, the refuse is instantly ignited by the fluidized high-temperature sand F and combusted in the so-called free board H in the incinerating furnace D.

The resulting hot products of combustion are withdrawn, together with dust particles, from the top exit I of the furnace D, into an ancillary system communicating with the top exit I, which includes a dust collector and a gas cooler or a heat-exchanger which are not shown.

The heavy non-combusted materials not withdrawn as dust particles are withdrawn downward, together with sand F, into a non-combustibles separator J and the sand F only is returned, by recycling means K, to the incinerating furnace D.

In the above vertical incinerator of the fluidized-bed type, however, a smooth combustion of refuse in the furnace calls for the provision of a crusher or bag breaker for pretreatment and a forced draft fan for fluidizing the sand in the furnace.

Furthermore, since the pressure of the air for combustion to be fed to the furnace must be very high, the conventional incinerator of this type has the drawback of large consumption power.

Moreover, since the amount of the dust discharged along with the hot products of combustion on the dust collector side is very large, the system requires a large-scale dust collector. Moreover, the voluminous dust tends to increase the incidence of troubles in the gas cooler or heat-exchanger system.

In addition, because a high-pressure air for combustion is fed into the furnace, the internal space of the furnace may assume a positive pressure, so that it is not only necessary to seal the refuse feeding port etc. but also necessary to increase the suction force of the induced draft fan used for withdrawing the hot products of combustion and dust from the furnace into the dust collector and other ancillary devices.

It is also essential to provide an additional step and apparatus for circulating the hearth sand.

In addition to the vertical fluidized-bed incinerator described above, there are pyrolysis type and slugging type incinerators as well.

In the incinerator of the pyrolysis type, the pressure of the combustion air to fed into the furnace must be increased to a considerably high level so as to allow the combustion air and hot products of combustion to effectively pass through the thick layer of refuse, with the result that the interior of the furnace may assume a positive pressure due to changes in the quality of refuse to be burned and, as in the case of the fluidized-bed incinerator, the refuse feeding and other ports must be sealed.

Moreover, as the gravity of refuse acts directly on the inside bottom of the furnace, special ingenuity is required in the design and construction of the means for withdrawing the accumulated ashes downward from the furnace bottom, thus adding to the complexity of the equipment.

The incinerator of the slugging type has the disadvantage that because the non-combustibles are withdrawn in high-temperature molten condition, there is a danger in handling.

It is also necessary to employ an additional chemicals. Moreover, the equipment consumes a large electric power. Thus, the slugging type incinerator is costly and economically disadvantageous.

SUMMARY OF THE INVENTION

The above-mentioned disadvantages of the prior art incinerators are overcome by the present invention.

It is an object of the invention to provide an economical vertical incinerator which requires only a low pressure for combustion air to be fed into the furnace, does not require means for pretreatment of refuse or blower means for fluidizing sand in the furnace, and has a reduced power consumption.

It is another object of the invention to provide a vertical incinerator free of the risk of generation of positive pressure in the furnace, thanks to the low pressure used for combustion air, thus eliminating the need for sealing the refuse feeding and other ports.

It is still another object of the invention to provide a vertical incinerator featuring a reduced amount of dust discharged on the dust collector side along with hot products of combustion and thereby reducing the burden on the dust collector and the incidence of troubles in the ancillary systems such as the gas cooler or heat-exchanger.

It is a further object of the invention to provide a vertical incinerator which can effectively utilize the energy of hot products of combustion.

The above and further objects, features and advantages of the invention will more fully appear from the following description with reference to the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
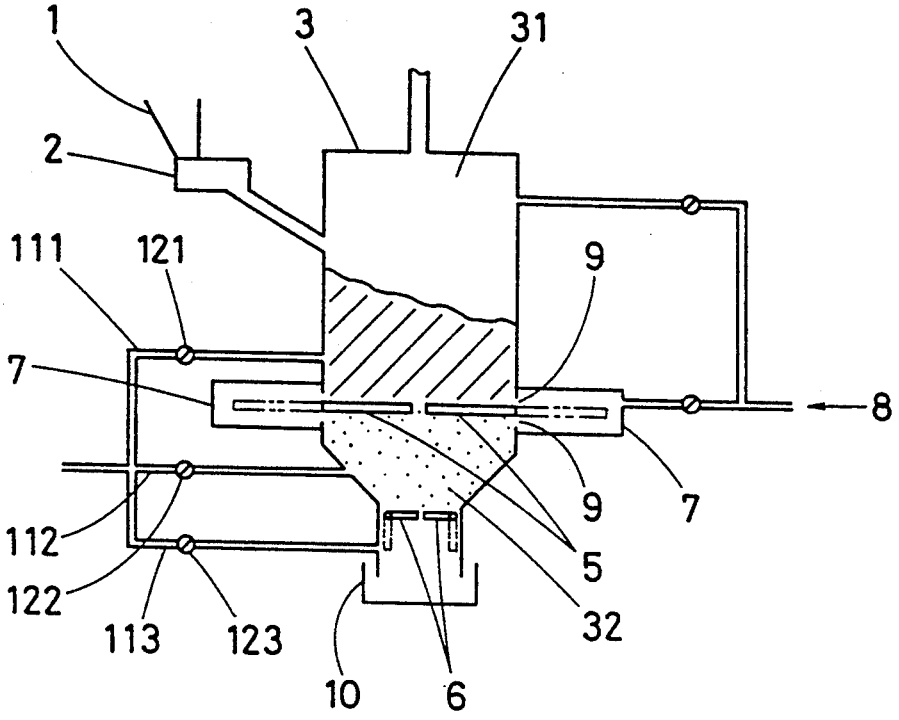
FIG. 1 is a schematic side-elevation view showing the vertical incinerator of the invention.
Figure 2:
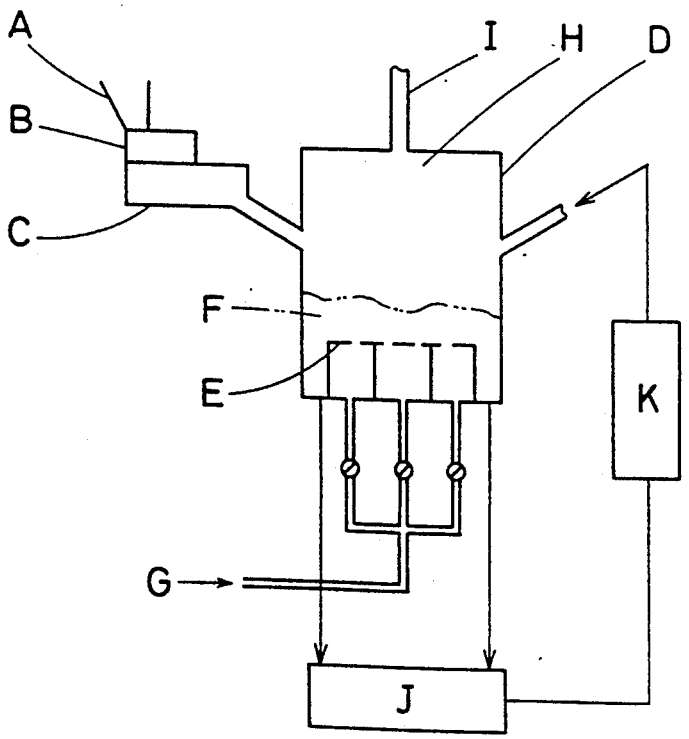
Fig. 2 PRIOR ART
FIG. 2 is a schematic side-elevation view showing the prior art incinerator of the fluidized-bed type.

Referring to FIG. 1 which illustrates the vertical incinerator of the invention in schematic representation, the reference numeral 1 represents a hopper for refuse. Thus, the refuse pooled in a refuse pit (not shown) is first pulverized or broken up to some extent for mixing and then fed to the hopper 1 by means of a crane (not shown).

The hopper 1 communicates with the top of a furnace 3 via a feeder 2 so that the refuse charged into the hopper 1 is fed, in metered amounts, to the furnace 3.

The furnace 3 is provided with a first set of grates 5,5 forming an upper hearth and a second set of grates 6,6 forming a lower hearth, each set being free to be opened and closed, in such a manner that the internal space of the furnace 3 is divided into a first combustion chamber 31 and a second combustion chamber 32.

The grates 5,5 of the first set are disposed at both sides of the furnace 3 in such a manner that they can move in a horizontal plane. These grates 5,5 are normally projecting into the furnace 3 to form a dividing wall and the refuse fed to the first combustion chamber 31 is intercepted by the first set of grates 5,5.

Provided on both sides of the furnace 3 where said first set of grates 5,5 are disposed are grate compartments 7,7 which are adapted to accommodate the grates 5,5 of the first set when the grates are retreated from the internal space of the furnace 3. These compartments 7,7 are supplied with air 8 at atmospheric temperature.

The above-mentioned air 8 is blown out into the furnace 3 through the clearances 9,9 formed between the furnace 3 and the respective compartments 7,7 to cool the first set of grates 5,5 and, at the same time, prevent entry of the ashes produced in the furnace 3 into the compartments 7,7 through the clearances 9,9. Moreover, this air 8 at atmospheric temperature is fed as a secondary air to the top of the first combustion chamber 31.

In the furnace 3, grates 6,6 of the second set are installed in such a manner that is can be swung down into the vertical positions indicated by two dots-broken line in FIG. 1. As the grates 6,6 of the second set are swung down, the ashes in the second combustion chamber 32 are withdrawn into ash withdrawal means 10 disposed below the furnace 3.

The lower parts of the first combustion chamber 31, second combustion chamber 32 and second set of grates 6,6 are supplied with combustion airs of controlled temperature 111, 112 and 113 by way of dampers 112, 1222 and 123, respectively.

The above combustion airs 111, 112 and 113 are respectively adjusted to the optimum temperatures according to the quality of refuse to be burned but the air 113 to be fed to the bottom of the furnace 3 is maintained at a high temperature at all times for executing the final burning.

The process of combustion of refuse in the vertical incinerator thus constructed is explained below.

The refuse pooled in the hopper 1 is fed by the feeder 2, in metered amounts, into the first combustion chamber 31 of the furnace 3 and settles on the first set of grates 5,5.

By the combustion air 111 fed to the first combustion chamber 31, the refuse deposited in the first combustion chamber 31 is caused to burn. This combustion spreads gradually from the lower layer of the refuse to the whole space of the first combustion chamber 31. In this manner, the refuse which is easy to burn is completely combusted to ashes in this first combustion chamber 31. The resulting hot products of combustion ascend through the first combustion chamber 31. Thus, all the hot products of combustion produced in the lower part of the first combustion chamber 31 ascend through the refuse layer in the first combustion chamber. The heat of the ascending hot products of combustion promotes the ignition and gasification of the refuse in the upper layer and dries the raw refuse. Furthermore, the hot products of combustion ascending to the top of the first combustion chamber 31 are recombusted by the secondary air 8 fed to the top of the chamber. By the radiant heat of this recombustion, the refuse fed into the first combustion chamber 31 is preliminarily dried and the paper and plastics having low ignition points are ignited to promote generation of fire seeds.

Then, when the combustion has progressed to a certain extent, the first set of grates 5,5 is opened to drop the combustion residues in the first part of the first combustion chamber 31 onto the second set of grates 6,6 forming the lower hearth in the amount corresponding to the volume of the second combustion chamber 32.

Then, the first set of grates 5,5 is closed again. The combustion residues falling into the second combustion chamber 32 are ashes including some hardly combustible materials and unburned combustibles since there is only a low resistance due to dust, the first set of grates 5,5 can be smoothly closed.

Since the first grates 5,5 support the refuse load in the first combustion chamber 31, there is no downward compression to the combustion residues in the second combustion chamber 32. Moreover, the blocks of unburned combustibles are disintegrated by the shock of falling. Therefore, the combustion residues accumulated in the second combustion chamber 32 are highly permeable to air. Therefore, as combustion airs of high temperature 112 and 113 are supplied, the unburned materials materials in the combustion residues are readily burned by the remaining fire seeds. Moreover, because of the high permeability of the combustion residues, the pressure of combustion airs 112 and 113 need not be high. Furthermore, the hot products of combustion generated in the second combustion chamber 32 ascend through the first combustion 31 to further assist in the combustion in the first combustion chamber 31, thus making a full utilization of the thermal energy of combustion.

Then, as the combustion in the second combustion chamber 32 is completed, the second set of grates 6,6 is swung down to drop the ashes in the second combustion chamber 32 into the ash withdrawal means 10.

Thus, in the vertical incinerator according to the present invention, the first and second sets of grates 5,5 and 6,6 are open and closed relatively to let the refuse to drop from the upper first combustion chamber 31 into the lower second combustion chamber 32 while it is constantly burned and the resulting ashes are discharged from the bottom ash withdrawal port.

During the combustion in the second combustion chamber 32, the first grates 5,5 are exposed to high temperature but since these grates 5,5 are cooled by the air of atmospheric temperature 8 supplied through the clearances between the furnace 3 and the respective compartments 7,7, they are protected against damage by the high temperature. Moreover, the air 8 prevents entry of ashes through said clearances 9,9 into the compartments 7,7.

While, in the above embodiments, the internal space of the furnace 3 is divided into two upper and lower chambers, namely a first combustion chamber and a second combustion chamber, it is possible to divide the furnace space into three or more combustion chambers employing three or more sets of grates.

Figure 3:
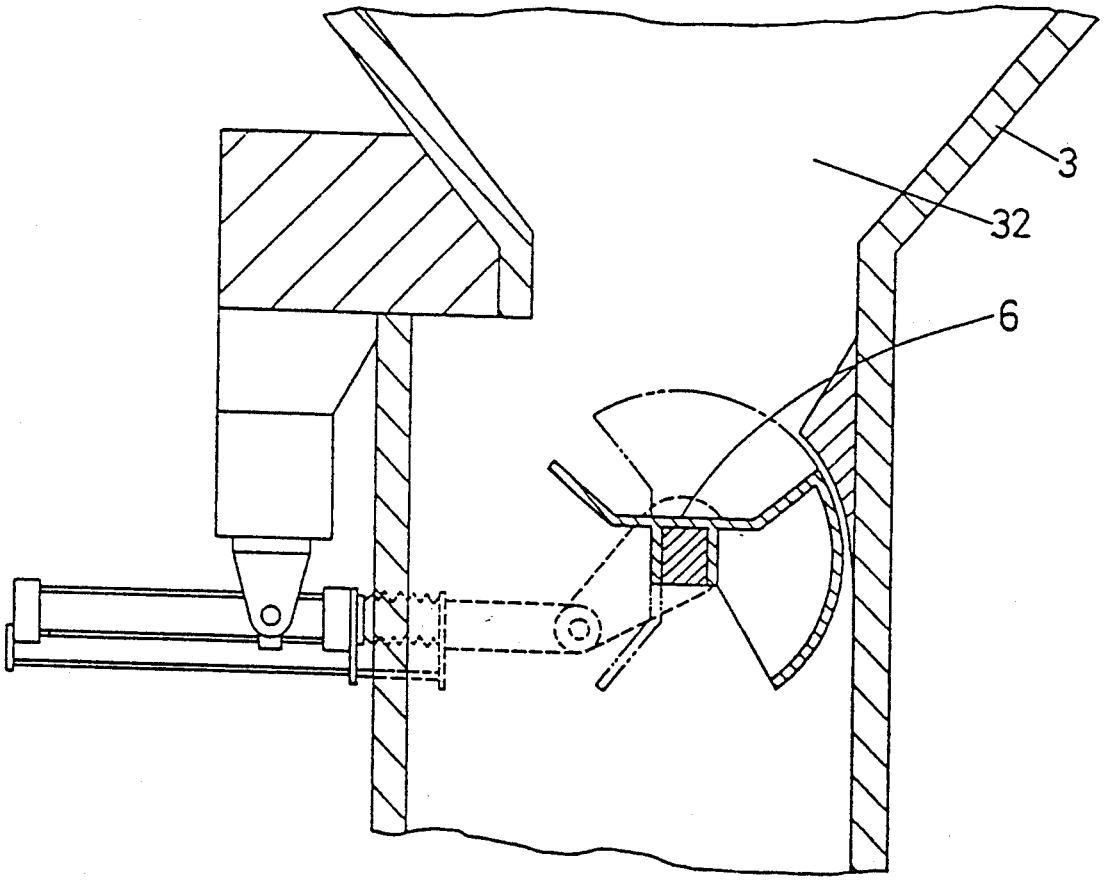
FIG. 3 is a detailed portion cross sectional view of an inclined reversible grate structure, showing another preferred embodiment of the invention.

The mechanisms for opening and closing the first and second sets of grates are not limited to those described and illustrated but, for example, the sme set of grates as the second set of grates 6,6 may be used for said first set of grates 5,5 and the so-called inclined reversing grate as shown in FIG. 3 may be used for the second set of grates 6,6.

While there has been described what is at present considered to be preferred embodiments of the invention, it will be understood that various modifications may be made therein, and it is intended to cover in the appended claims all such modifications as fall within the true spirit and scope of the invention.

What is claimed is:

1. A vertical incinerator for burning general refuse and industrial wastes which comprises:

a furnace equipped with a gas exit at its top and an ash withdrawal port at its bottom, a plurality of sets of grates adapted to open and close and divide said furnace into a plurality of combustion chambers when closed, a refuse feeder communicating with said furnace at the top thereof and adapted to feed refuse in metered amounts to the upper part of said combustion chambers, means for blasting cooling air against at least one of said sets of grates, and combustion air feeding means adapted to feed air for combustion to said combustion chambers, said sets of grates being opened and closed relatively in the order of the uppermost to the lowermost set to let the refuse drop successivley from the upper part of combustion chamber to the lower part of combustion chamber while it is burned and the ashes produced by combustion being discharged from said ash withdrawal port.

2. The vertical incinerator of claim 1 wherein said at least one of said sets of grates is movable in a horizontal direction, said means for blasting cooling air communicates with compartments provided at both sides of the furnace for accommodating said grates so that a cooling air from said means is blasted against said grates, preventing entry of ashes into said compartment.

3. The vertical incinerator of claim 2 wherein each set of grates consists of two identical grates.

4. A vertical incinerator for burning general refuse and industrial wastes which comprises:

a furnace equipped with a gas exit at its top and an ash withdrawal port at its bottom, a plurality of sets of grates adapted to open and close and divide said furnace into a plurality of combustion chambers when closed, a refuse storage hopper, a refuse feeder communicating with said furnace at the top thereof and adapted to feed refuse in metered amounts from the hopper to the upper part of said combustion chambers, means for blasting cooling air against at least one of said sets of grates, means mounting a lowermost set of said grates for swinging movement from a horizontal closed position to a vertical open position, means mounting the other set or sets of said grates for horizontal movement, a compartment at each side of said furnace for accommodating each one of said the other set or sets of grates, said means for blasting cooling air communicating with said compartments for blasting said cooling air through said compartments against said grates and for preventing entry of ashes into said compartments, and combustion air feeding means adapted to feed air for combustion to said combustion chambers, said sets of grates being opened and closed relatively in the order of the uppermost to the lowermost set to let the refuse drop successively from the upper part of combustion chamber to the lower part of combustion chamber while it is burned and the ashes produced by combustion being discharged from said ash withdrawal port.

5. The vertical incinerator of claim 4 wherein each set of grates consists of two identical grates.

6. The vertical incinerator of claim 1 or claim 4 wherein the lowermost set of grates is an inclined reversible grate structure.

7. The vertical incinerator of claim 1 or claim 4 including means for feeding air at atmospheric temperature to the uppermost combustion chamber as secondary air.

8. The vertical incinerator of claim 1 or claim 4 including means for feeding air for combustion the ash withdrawal port.

* * * * *